United States Patent [19]

Tominaga

[11] Patent Number: 4,556,198

[45] Date of Patent: Dec. 3, 1985

[54] HEIGHT ADJUSTING LIFTER FOR HOSPITAL BED

[75] Inventor: Hiroshi Tominaga, Kanagawa, Japan

[73] Assignee: Fuji Electric Co., Ltd., Kanagawa, Japan

[21] Appl. No.: 562,882

[22] Filed: Dec. 19, 1983

[51] Int. Cl.[4] ..... B66F 3/22

[52] U.S. Cl. ..... 254/122; 5/63

[58] Field of Search ..... 254/9 R, 9 B, 9 C, 122, 254/124; 187/18, 8.72; 182/69, 63, 157, 141, 14, 16; 5/63

[56] References Cited

U.S. PATENT DOCUMENTS

| | | | |
|---|---|---|---|
| 2,501,001 | 3/1950 | Neely | 254/122 |
| 3,282,566 | 11/1966 | Clarke | 254/122 |
| 3,373,453 | 3/1968 | Goodman | 254/122 |
| 4,092,011 | 5/1978 | Luebke | 254/122 |

*Primary Examiner*—Robert C. Watson

*Attorney, Agent, or Firm*—Sughrue, Mion, Zinn, Macpeak, and Seas

[57] ABSTRACT

A lifter for supporting a hospital bed and for adjusting the height of the same. The lifter includes an upper frame supporting the bottom of the bed, a lower frame disposed on the floor, a link mechanism extending between the upper and lower frames and made vertically expandible and collapsible when actuated and released, and a hydraulic cylinder for actuating and releasing the link mechanism. The link mechanism includes a first pair of right and left link arms each having one end fixed at and rotatably borne on either of the upper and lower frames and its other free end carried longitudinally movably on the other frame. A second pair of right and left link arms intersect, in a side view, with the link arms of the first pair, respectively, and each has one end fixed at and rotatably borne on the other frame and its other free end carried longitudinally movably on the one frame. The bearings, the rollers and the guide rails are generally transversely aligned so that they are prevented from overlying one another, whereby the link arms of the first and second pairs can be folded to assume generally horizontally and longitudinally extending positions.

4 Claims, 4 Drawing Figures

HEIGHT ADJUSTING LIFTER FOR HOSPITAL BED

BACKGROUND OF THE INVENTION

The present invention relates to a hospital bed and, more particularly, to an improvement in the construction of a lifter for adjusting the height of a hospital bed.

From the standpoint of transferring a patient from bed to bed or allowing the patient to get in and out of the bed, the height of a hospital bed from the floor is desired to be as small as possible. On the other hand, for a nurse or doctor to minister to a patient lying on the bed, the bed height is desired to have a higher level. In order to satisfy these two opposing demands, there is known in the art a structure in which a bed is combined with a lifter so that its height can be adjusted as needed. For the lifter, a vertically expandible and collapsible link mechanism is used, as in an industrical table lifter of the hydraulic type. The link mechanism is actuated by an actuator device such as a hydraulic cylinder so that the bed may be moved up and down. In this system, the link mechanism should be capable of minimizing the height of the bed when the link mechanism is collapsed to its lowermost position.

SUMMARY OF THE INVENTION

Accordingly, a primary object of the present invention is to provide a height adjusting lifter for a hospital bed which has a link mechanism designed so that the height of the bed can be minimized when the bed is in its lowermost position.

According to the present invention, there is provided a lifter for a hospital bed for adjusting the height of the same including: an upper frame supporting the bottom of the bed; a lower frame which rests on the floor; a link mechanism extending between the upper and lower frames and vertically expandible and collapsible when actuated and released, respectively; and actuating and releasing means for actuating and releasing the link mechanism, wherein the improvement resides in that the link mechanism includes a first pair of right and left link arms each having one end fixed at and rotatably borne on one of the upper and lower frames and its other free end carried longitudinally movably on the other of the upper and lower frames; a second pair of right and left link arms sidewise intersecting the right and left link arms of the first pair, respectively, and each having its one end fixed at and rotatably borne on the other frame and its other free end carried longitudinally movably on the one frame; first bearing means for rotatably bearing the fixed ends of the right and left link arms of the first pair; second bearing means for rotatably bearing the fixed ends of the right and left link arms of the second pair; first carrying means for carrying the other free ends of the right and left link arms of the first pair; and second carrying means for carrying the other free ends of the right and left link arms of the second pair, the first and second bearing means and the first and second carrying means being mounted on the fixed and other free ends of the right and left link arms of the first and second pairs and on the upper and lower frames such that the right and left link arms of the first pair are positioned transversely inside of those of the second pair, whereby the right and left link arms of the first and second pairs as well as the first and second bearing means and the first and second carrying means are prevented from overlying one another when the link mechanism is collapsed to bring the bed into its lowermost position.

According to another but important feature of the present invention, in the lifter described above, the first and second bearing means and the first and second carrying means are arranged such that they are generally transversely aligned at the respective two longitudinal ends when the link mechanism is collapsed to bring the bed into the lowermost position to allow the right and left link arms of the first and second pairs to assume generally horizontally and longitudinally extending positions, whereby the height of the bed in the lowermost position is minimized.

BRIEF DESCRIPTION OF THE DRAWINGS

Other objects, features and advantages of the present invention will become more apparent from the following description taken in conjunction with the accompanying drawings, in which.

DESCRIPTION OF THE PREFERRED EMBODIMENT

Figure 1:
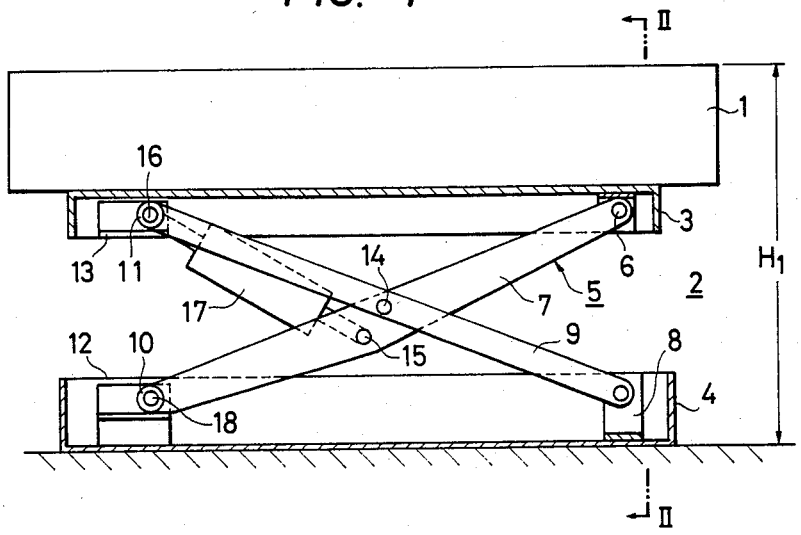
FIG. 1 is a sectional side elevation view showing a height adjusting lifter for a hospital bed according to the present invention in the uppermost position of the bed.
Figure 2:
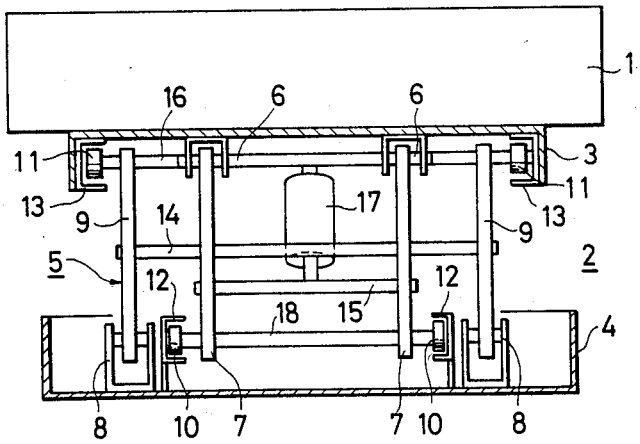
FIG. 2 is a sectional front elevation view taken along a line II—II in FIG. 1.
Figure 3:
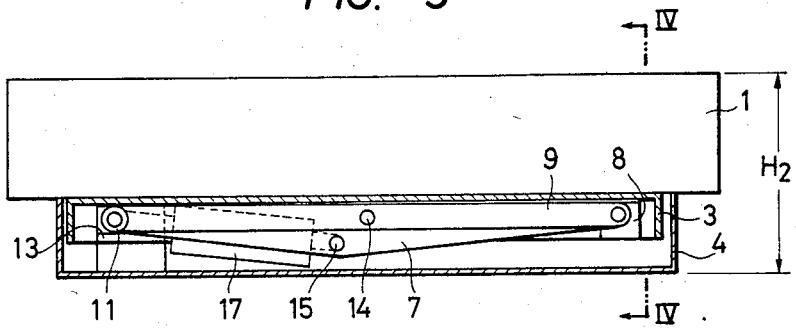
FIG. 3 is a view similar to FIG. 1 but showing the height adjusting lifter when the bed is in its lowermost position.
Figure 4:
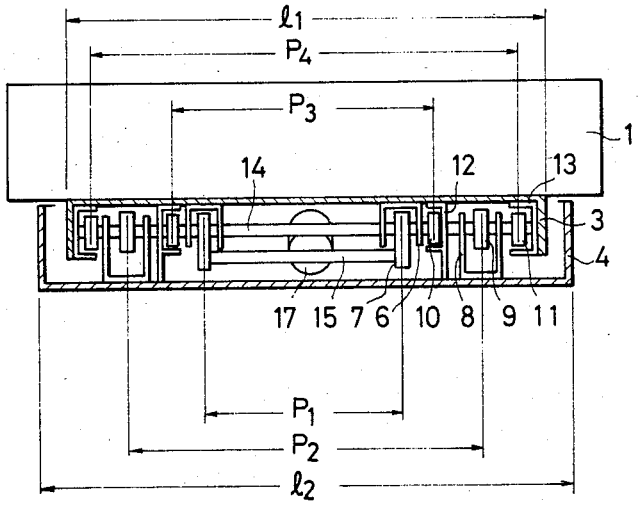
FIG. 4 is a view similar to FIG. 2 but taken along a line VI—VI in FIG. 3.

FIGS. 1 and 2 show a hospital bed of the invention in the state in which the bed 1 is raised to its uppermost position. FIGS. 3 and 4 show the state in which the bed is lowered to its lowermost position. Indicated at reference numeral 2 is a lifter according to the present invention for supporting and raising and lowering the bed 1. The lifter 2 includes an upper frame 3 supporting the bottom of the bed 1; a lower frame 4 resting on the floor; a link mechanism 5 extending between the upper and lower frames 3 and 4 and vertically expandible and collapsible when actuated and released; and an actuating hydraulic cylinder 17 for actuating and releasing the link mechanism 5.

The link mechanism 5 will be described in more detail. The link mechanism 5 includes a first pair of right and left link arms 7, each having one end fixed at and rotatably borne on the upper frame 3 through a bearing 6; a second pair of right and left link arms 9 positioned transversely outside of the right and left link arms 7 and each having one end fixed at and rotatably borne on the lower frame 4 through a bearing 8; two pairs of right and left rollers 10 and 11 rotatably bearing the other free ends of the right and left link arms 7 and 9 of the first and second pairs through pins 18 and 16; two pairs of right and left guide rails 12 and 13 mounted in transverse alignment on the bottom of the lower and upper frames 4 and 3 and guiding therein the right and left rollers 10 and 11 while allowing them to roll therein in the longitudinal direction; and a pin 14 coupling the intersecting intermediate portions of the right and left link arms 7 and 9 of the first and second pairs. The ends of the hydraulic cylinder 17 are connected between a pin 15, which extends through the right and left link arms 7 at a position offset from the aforementioned pin 14, and a pin 16, which extends through the other free ends of the right and left link arms 9.

As best seen in FIG. 4, the following inequalities hold in this link mechanisms: $P_1<P_2$; $P_3<P_4$; and $l_1<l_2$, wherein: the bearing pitch between the paired right and left bearings 6 is designated by $P_1$; the bearing pitch between the paired right and left bearings 8 is designated by $P_2$; the roller pitch between the paired right and left rollers 10 is designated by $P_3$; the roller pitch between the paired right and left rollers 11 is designated by $P_4$; the length of the upper frame 3 is designated by $l_1$; and the length of the lower frame 4 is designated by $l_2$. Moreover, the bearings 6 and 8 and the rollers 10 and 11 are arranged to be so transversely offset from each other that they are prevented from overlying one another when the link mechanism 5 is collapsed to bring the bed 1 into its lowermost position.

In the arrangement thus far described, when the oil pressure is released from the hydraulic cylinder 17 when the bed 1 is in its uppermost position shown in FIGS. 1 and 2, the rollers 10 and 11 of the paired inner and outer link arms 7 and 9 roll in the guide rails 12 and 13 until the link mechanism 5 is collapsed to bring the bed 1 into its lowermost position shown in FIGS. 3 and 4. In other words, the bed 1 is lowered from a height $H_1$ corresponding to the uppermost position of FIG. 1 to a height $H_2$ corresponding to the lowermost position of FIG. 3. When oil pressure is introduced into the hydraulic cylinder 17 when the bed 1 is in the lowermost position shown in FIGS. 3 and 4, the link mechanism 5 is extended upward to bring the bed 1 into the uppermost position.

As clearly seen from FIG. 4, in the lowermost position, the bearings 6 and 8, the rollers 10 and 11 and the guide rails 12 and 13 are generally transversely aligned so that they are prevented from overlying one another, whereby the right and left link arms 7 and 9 can be folded into generally horizontally and longitudinally extending positions. As a result, the bed height $H_2$ in the lowermost position is minimized so that the lifter according to the present invention significantly improves the function of the bed.

I claim:

1. In a lifter for supporting and raising and lowering a hospital bed, comprising an upper frame supporting a bottom of said bed; a lower frame disposed on the floor; a link mechanism extending between said upper and lower frames and vertically expandable and collapsible when actuated and released, respectively; and actuating and releasing means for actuating and releasing said link mechanism, the improvement wherein said link mechanism comprises: a first pair of right and left link arms each having one end fixed at and rotatably borne on one of said upper and lower frames and another free end carried longitudinally movably on the other of said upper and lower frames; a second pair of right and left link arms sidewise intersecting said right and left link arms of said first pair, respectively, and each having one end fixed at and rotatably borne on said other frame and another free end carried longitudinally movably on said one frame; first bearing means for rotatably bearing fixed ends of said right and left link arms of said first pair; second bearing means for rotatably bearing said fixed ends of said right and left link arms of said second pair; first carrying means for carrying said free ends of said right and left link arms of said first pair; and second carrying means for carrying said free ends of said right and left link arms of said second pair, said first and second bearing means and said first and second carrying means being mounted on said fixed and free ends of said right and left link arms of said first and second pairs and on said upper and lower frames such that said right and left link arms of said first pair are positioned transversely inside of those of said second pair, whereby said right and left link arms of said first and second pairs as well as said first and second bearing means and said first and second carrying means are prevented from overlying one another when said link mechanism is lowered to bring said bed into a lowermost position, wherein said actuating and releasing means includes a hydraulic cylinder having a movable arm end connected to said right and left link arms of said first pair at a position offset from a pivot point of said link mechanism and a base end connected to a rod connecting said free ends of said right and left link arms of said second pair, and hydraulically extendible and contractable for vertically moving said right and left link arms of said first and second pairs relative to each other, and wherein said first bearing means comprises a first pair of right and left bearings mounted in transverse alignment on a bottom of said upper frame, wherein said second bearing means comprises a second pair of right and left bearings mounted in transverse alignment on a bottom of said lower frame, wherein said first carrying means comprise a first pair of right and left guide rails mounted in transverse alignment on said bottom of said lower frame; a first pair of right and left guide rails mounted in transverse alignment on said bottom of said lower frame; a first pin extending through said free ends of said right and left link arms of said first pair; and a first pair of right and left rollers mounted rotatably on right and left ends of said first pin and guided in said right and left guide rails of said first pair, and wherein said second carrying means comprises: a second pair of right and left guide rails mounted in transverse alignment on said bottom of said upper frame; and a second pair of right and left rollers mounted rotatably on right and left ends of said rod and guided in said right and left guide rails of said second pair, said base end of said hydraulic cylinder being mounted to said rod at a location between said second pair of right and left rollers, and substantially equidistant to said right and left guide rails of said second pair of guide rails.

2. The lifter as set forth in claim 1, wherein said first and second bearing means and said first and second carrying means are arranged such that they are generally transversely aligned at respective two longitudinal ends when said link mechanism is lowered to bring said bed into said lowermost position to allow said right and left link arms of said first and second pairs to assume generally horizontally and longitudinally extending positions, whereby the height of said bed in said lowermost position is minimized.

3. The lifter as set forth in claim 1, wherein the following inequalities hold:

$$P_1<P_2,$$

$$P_3<P_4, \text{ and}$$

$$l_1<l_2,$$

in which:

a bearing pitch between said right and left bearings of said first pair is designated by $P_1$;

a bearing pitch between said right and left bearings of said second pair is designated by $P_2$;

a roller pitch between said right and left rollers of said first pair is designated by $P_3$;

a roller pitch between said right and left rollers of said second pair is designated by $P_4$;

a length of said upper frame is designated by $\mathbf{1}_1$; and a length of said lower frame is designated by $\mathbf{1}_2$.

4. The lifter as set forth in claim 1, wherein said link mechanism further comprises a third pin extending through said right and left link arms of said first and second pairs for coupling intersecting intermediate portions of the same.

* * * * *